United States Patent [19]

Sanford

[11] 4,244,590

[45] Jan. 13, 1981

[54] INFLATABLE PACKER CONSTRUCTION

[76] Inventor: Lawrence Sanford, 4047 Hollister, Houston, Tex. 77055

[21] Appl. No.: 788,599

[22] Filed: Apr. 18, 1977

[51] Int. Cl.[3] ..... F16J 15/46

[52] U.S. Cl. ..... 277/34.3

[58] Field of Search ..... 277/34.3, 34.6, 9.5

[56] References Cited

U.S. PATENT DOCUMENTS

| | | | |
|---|---|---|---|
| 3,044,553 | 7/1962 | Bradley | 277/9.5 |
| 4,003,581 | 1/1977 | Hutchison et al. | 277/34.6 |
| 4,082,298 | 4/1978 | Sanford | 277/34.3 |

*Primary Examiner*—Robert I. Smith

*Attorney, Agent, or Firm*—Browning, Bushman & Zamecki

[57] ABSTRACT

An inflatable packer which can be easily constructed using tubular members such as a section of well casing, the packer having spaced, first and second annular heads which surround a central tubular member, the first head being slidable along the tubular member, a relief or attachment space being formed between the second head and the tubular member, a securing element being disposed in the relief for securing the second head to the tubular member and preventing relative longitudinal movement thereof, a centering member being disposed between the second head and the tubular member to maintain the second head and the tubular member in substantially coaxial relationship independent of the securing element, an inflatable, tubular element being attached to and extending between the first and second heads.

29 Claims, 5 Drawing Figures

FIG. 1
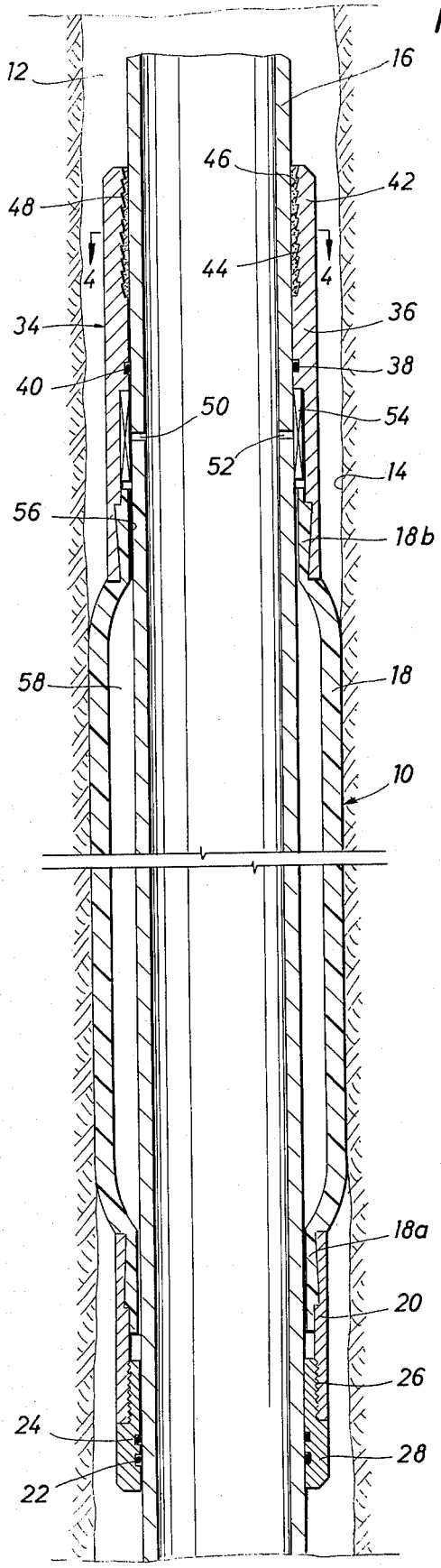
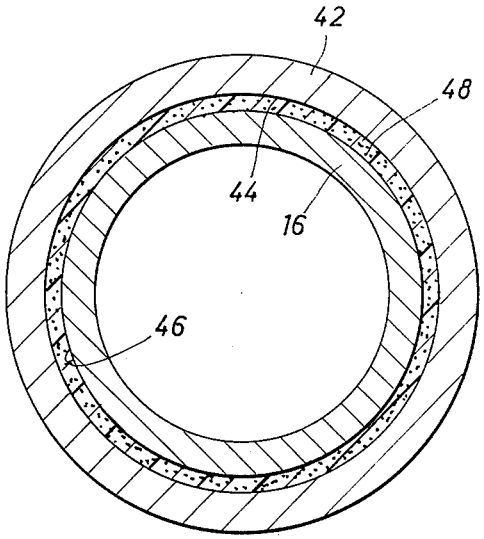
FIG. 4
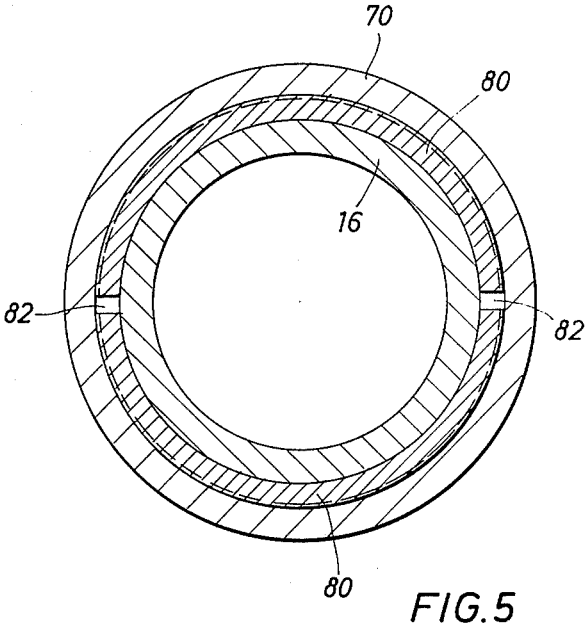
FIG. 5

INFLATABLE PACKER CONSTRUCTION

BACKGROUND OF THE INVENTION

The present invention relates to fluid inflatable elements and, more particularly, to inflatable packers which can be easily formed from readily available tubular members such as a section of well casing or the like.

Basically, an inflatable packer consists of a central tubular member or mandrel having an expandable sleeve thereon, the sleeve being connected at each end to spaced annular heads or collars which surround the tubular member. Typically, one of the heads is secured to the tubular member while the other head is free to slide to permit expansion of the sleeve by the application of fluid pressure in the well known manner.

Many types of inflatable packers and methods of constructing same are shown in the prior art. Thus, for example, U.S. Pat. Nos. 2,177,601 to Smith, 3,437,142 to Conover and 3,837,947 to Malone all show various inflatable packers or elements, or methods of forming same. None of the cited patents, which applicant considers to be the most pertinent to the present invention, show an inflatable packer construction which can utilize a readily available tubular section such as a section of well casing or the like to form a packer without the need for welding or relatively extensive machining. Thus, for example, the Smith and Malone patents show packers or inflatable elements wherein at least one of the heads or collars used in the packer construction is secured to the casing or central tubular member by welding. On the other hand, the Conover patent discloses an external casing packer in which the fixed head of the packer is secured to the casing by means of an intermediate threaded collar, threaded both to the head and to the casing.

The types of packer construction described above employing welding and/or a multiplicity of expensively machined parts suffer from several inherent disadvantages. In the case of packers constructed so that one of the packer heads is welded to the central, tubular member, metallurgical problems can arise. Today's deeper and deeper wells require the use of materials in casing, pipe and downhole tools, which can withstand extremely high pressures, corrosive conditions and extreme stresses. Accordingly, it is essential, when a component is to be used in such deep well environments, to ensure that any welded connections be stress relieved to ensure that the welded joint will not fail. Even when only metal components are involved, stress relieving the welded joint may present a problem since it requires special annealing or heat facilities. The need for such facilities virtually precludes on site construction of inflatable packers. However, even if such stress relieving facilities are available, there is a problem in the case of inflatable packers because the heat treating or annealing required to stress relieve the welded joints will damage, if not destroy, the elastomeric material used in forming the inflatable element. Thus, it is quite difficult, if not impossible, to stress relieve an inflatable packer having an elastomeric, expandable element once the packer has been completely constructed.

In the case of packers utilizing threaded connections to secure one of the packer heads to the central tubular member or mandrel, the difficulties are apparent. Such connections require relatively extensive machining and are, accordingly, expensive to manufacture. Again, the need for such machining makes it difficult, if not impossible, to construct the packers in the field.

SUMMARY OF THE INVENTION

It is therefore an object of the present invention to provide an improved inflatable packer.

Another object of the present invention is to provide an inflatable packer which can be easily constructed from a readily available tubular member such as a section of well casing.

Still a further object of the present invention is to provide an inflatable packer wherein the need for welding in the construction of the packer can be eliminated.

Yet another object of the present invention is to provide an inflatable packer which can be constructed from a minimum of machined components.

The above and other objects of the present invention will become apparent from the drawings, the description given herein and the appended claims.

The packer of the present invention is comprised of two main portions: one portion comprises a central, tubular member or mandrel which can be formed, for example, from a section of well casing or the like; the other portion comprises the inflatable or expandable element disposed on and in generally surrounding relationship to the central tubular member. The expandable or inflatable element includes a pair of annular heads or collars disposed on the central tubular member and longitudinally spaced therealong, one of the heads being sealingly slidable on the tubular member. The other of the heads, the fixed head, has an attachment portion and there is a relief or space formed between the attachment portion and the central tubular member. A securing means is disposed in the relief for securing the attachment portion to the tubular member and there are provided, in addition, centering means which are disposed between the fixed head and the tubular member for maintaining the latter components in substantially coaxial relation, independently of the securing means. Lastly, an expandable, tubular element extends between and is secured to the first and second heads.

In one of the preferred embodiments, the securing means comprises an adhesive, such as an epoxy resin, which is disposed in the relief and which serves to adhesively secure the fixed head and the central tubular member together.

In a second preferred embodiment, the securing means includes means for grippingly engaging the central tubular member, the gripping means secured to the fixed head by suitable means such as threading.

BRIEF DESCRIPTION OF THE DRAWINGS

FIG. 1 is an elevational, sectional view showing a packer of the present invention positioned in a well bore and in inflated position.

FIG. 4 is a view taken along the lines 4—4 of FIG. 1.

FIG. 5 is a view similar to FIG. 4 showing the embodiment of FIG. 3.

DESCRIPTION OF THE PREFERRED EMBODIMENT

In the description which follows, particular reference will be made to the use of an inflatable packer as a casing packer used to pack off a section of a well bore.

However, it is to be understood that the present invention finds use in other types of inflatable elements and can be used as sealing elements in mine shafts or other openings in which the packer or inflatable element is positioned.

Figure 2:
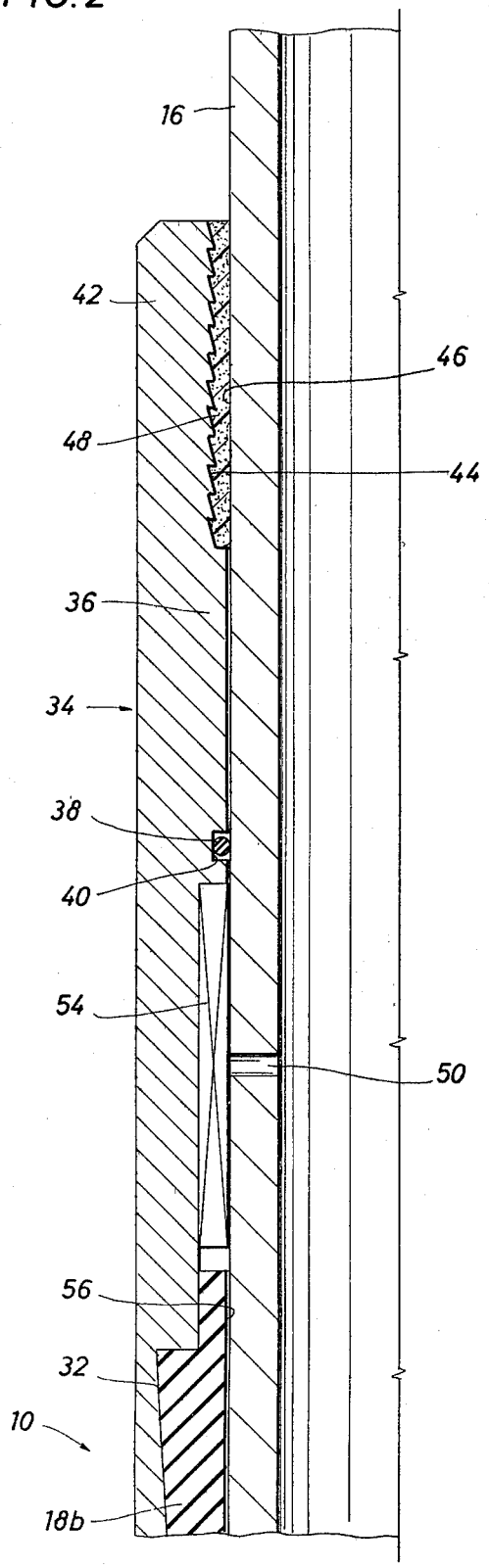
FIG. 2 is an enlarged, sectional view of a portion of the packer shown in FIG. 1.

Referring first to FIGS. 1, 2 and 4, the inflatable packer, shown generally as 10, is seen positioned, in inflated condition, in a well bore 12, the packer 10 sealing engaging the walls 14 of bore 12. The packer 10 is comprised of a section of ordinary well casing 16, which, as will be understood by those skilled in the art, can be threadedly connected at its opposite ends to adjacent sections of well casing or other well tools. Packer 10 includes a tubular, expandable element or sleeve 18 surroundingly disposed with respect to casing 16. One end 18*a* of expandable element 18 is connected, in a well known manner, to a retainer sleeve 20. Sleeve 20 is secured to an annular head or collar 28, head 28 having an externally threaded portion 26 threadedly received in sleeve 20. Collar or head 38 is slidingly disposed on casing 16, sealing between head 28 and casing 16 being provided by O-ring seals 22 and 24.

The other end 18*b* of expandable element 18 is secured to a second annular head or collar shown generally as 34. Head 34 is provided with an annular, radially inwardly extending rib or upset portion 36 which serves to center head 34 substantially coaxially with respect to casing 16. In general, rib or upset portion 36 of head 34 will be dimensioned such that head 34 and casing section 16 will be permitted relative longitudinal movement when packer 10 is being assembled, i.e. rib 36 and casing 16 will be slidably spaced. Sealing between casing 16 and head 34 is accomplished by means of an O-ring 38 disposed in an annular recess 40 in rib 36. Head 34, which is the fixed head, has an attachment portion 42 axially spaced from rib 36, portion 42 having an internal, serrated or grooved surface 44, the average diameter of which is larger than the diameter of the outer surface of casing 16. There is thus formed an annular relief or space 36 between the outer surface of casing 16 and the inner surface of head 34, and, more specifically, attachment portion 42. Disposed in annular relief 36 is an adhesive 48, such as an epoxy resin, which is bonded both to wall 44 of attachment portion 42 of head 34 and the outer surface of casing 16. Adhesive 48 serves to fix head 34 with respect to casing 16 and prevent relative longitudinal movement thereof.

Extending radially through the walls of casing 16 are ports 50 and 52. An annular valve element 54 surrounds casing 16 and serves to close off ports 50 and 52. Valve element 54 is of a type which will admit fluid under pressure from the interior of casing 16 through ports 50 and 52 and thence into an annulus 56 between the outer surface of casing 16 and the inner surface of expandable element 18. It will be appreciated that when fluid is admitted through ports 50 and 52 in the manner described above, the pressure of the fluid will urge expandable element 18 radially outwardly into sealing engagement with the wall 14 of bore 12, head 28, the sliding head, being longitudinally displaced along casing 16. Thus, an annular chamber 58 filled with the fluid under pressure will be formed between the outer surface of casing 16 and the inner surface of expandable element 18. Valve element 54 will, of course, prevent the fluid in chamber 58 from bleeding back into casing 16.

Figure 3:
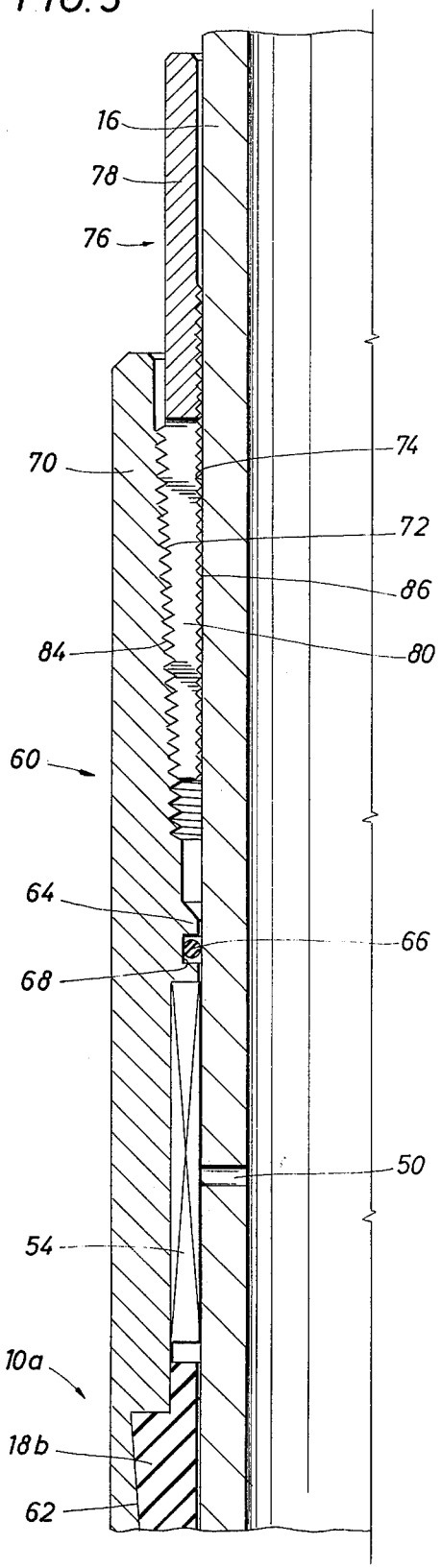
FIG. 3 is a view similar to FIG. 2 and shows another embodiment of the packer of the present invention.

Referring now to FIGS. 3–5, there is shown a second embodiment of the inflatable packer of the present invention. Packer 10*a* shown in FIG. 3 has an annular head or collar, shown generally as 60, the end 18*b* of expandable, tubular element 18 being secured to head 60 as at 62. Head 60 is provided with an annular, radially inwardly extending rib or upset 64 which, like rib 36 of packer 10, slidingly fits around casing 16 and serves to substantially, coaxially center casing 16 with respect to head 60. Sealing between casing 16 and head 60 is provided by O-ring 66 disposed in an annular recess 68 in rib 64. An attachment portion 70 of head 60 has an inwardly tapered threaded section 72 on its inner periphery. It will be apparent that since the diameter of the inwardly tapered threaded section 72 of attachment portion 70 is greater than the outside diameter of casing 16, an annular relief 74 is formed between attachment portion 70 and casing 16. A collet member, shown generally as 76, has a collar portion 78 from which longitudinally depend a pair of collet fingers 80. As best seen with reference to FIG. 5, collet fingers 80 are formed by providing longitudinally extending splits or slots 82 in collet member 76. Collet fingers 80 are provided with inwardly tapered threaded sections 84 on their outer periphery which are threadedly received in threaded section 72 in attachment portion 70. Fingers 80 are also provided, on their radially inner surfaces, with gripping teeth 86. It will be apparent that when collet 76 and head 60 are screwed together by engagement of threaded section 72 and 84, collet fingers 80 of collet member 76 will be urged radially inwardly such that teeth 86 on collet fingers 80 will bite into and grippingly engage casing 16. Thus, head 60 will be fixed relative to casing 16. It will be understood that the remaining portion of packer 10*a* is similar to packer 10 shown in FIG. 2.

In constructing a packer according to the present invention, a suitable tubular member, such as a section of well casing, is selected. In this regard it will be noted that the central tubular member is not limited to any length. The inflatable assembly consisting of the expandable, tubular element and the annular heads is then slipped over the casing and positioned wherever desired. If adhesive is to be used as the securing means, the adhesive composition is disposed in the relief or reliefs, as the case may be, and the adhesive composition allowed to cure to secure the fixed head to the casing. If the means of securing comprises a collet member or other gripping means, disposed in the relief(s), the collet member and the fixed head would simply be screwed together at the desired location on the casing. It should be noted that one of the advantages of the present invention wherein the securing means comprises a collet assembly or the like lies in the fact that the packer can be easily disassembled and removed from the casing or tubular member if desired.

While in the description above, the centering means has been described with reference to an annular, radially inwardly extending rib or upset formed by a portion of the head to be secured to the casing (fixed head), it will be appreciated that the centering means could be an annular, externally extending rib or upset from the central tubular member, i.e. the casing. Other centering means such as a ring disposed between the fixed head and the central tubular member can also be employed. It is only necessary that the centering means be independent of the means used to secure the fixed head to the central tubular member.

The relief or attachment space formed between the fixed head and the central tubular member will, as shown, preferably take the form of an annulus between an attachment portion of the fixed head and the central tubular member or casing. However, other relief spaces can be utilized as well. For example, the head could be provided with circumferentially spaced, radially inwardly opening recesses or pockets, the recesses or pockets providing attachment space in which to dispose the securing means. In such case, the adhesive material would be disposed in each of the pockets or recesses or, alternately, a series of individual gripping members such as slips could be disposed in the recesses or pockets. It will also be appreciated that in the case where a plurality of attachment reliefs or spaces is provided, some of the spaces could employ the gripping elements, i.e. slips, as a securing means while adhesive compositions could be used in the other attachment spaces.

The adhesive composition used in securing the fixed head to the central tubular member can be of any suitable type which will withstand the environment in which the packer is to be employed. Thus an adhesive which cures at room temperature, or one which cures more readily at elevated temperatures can be used. For example, and preferably, an epoxy resin, cured by suitable catalysts well known to those in the art can be employed. Thus, for example, the epoxy compositions disclosed in U.S. Pat. No. 3,003,798 to Sandlin can be advantageously used. Depending upon the pressures, temperatures and stresses to which the packer will be subjected, other suitable adhesives can also be employed. When an adhesive is used as the securing means, it is preferable, albeit not necessary, that the inner surface of the fixed head to which the adhesive is bonded be provided with irregularities such as the serrations or grooves described above. Such surface irregularities aid in preventing separation of the fixed head from the central tubular member. Surface irregularities can also advantageously be formed on the central tubular member contiguous the attachment relief or space.

The expandable tubular element used in the packer of the present invention can be constructed in various forms. Thus, for example, the tubular, expandable element may be constructed as shown in U.S. Pat. Nos. 3,104,717 to Sandlin, 3,837,947 to Malone, 2,779,491 to Mounce, and 3,542,127 to Malone. The expandable, tubular element can be completely elastomeric, being made of rubber or similar type elastomeric material, or, as in the case shown in many of the cited patents, can, with advantage, include reinforcing sleeves or liners comprised of braided or interwoven metallic cables and the like. The means of attaching or securing the expandable elements to the packer heads or collars can be accomplished by vulcanizing or as for example, by the method shown in U.S. Pat. No. 3,003,798 to Sandlin and other of the patents cited above. In general, the construction, per se of the inflatable or expandable, tubular elements and methods for securing same to the packer heads are well known to those skilled in the art as demonstrated by the patents cited above.

In the embodiments described above, the packer has been shown as being permanently inflatable in the sense that the valve element 54 has been described as a one-way check valve. The invention is not so limited. Valving assemblies which will permit both setting and unsetting of the packer can be employed. Such assemblies are well known in the prior art and need not be described in detail here. When, however, it is desired to provide a permanently set, inflatable packer using a one-way check valve, the valve assembly shown in copending application Ser. No. 781,418, filed concurrently herewith, and entitled, INFLATABLE PACKER, can be used most advantageously. Also, the one-way check valve shown in U.S. Pat. No. 2,177,601 to Smith can be employed if desired. It will also be apparent that the porting in the casing or central tubular member through which the inflating fluid flows can be varied both as to the number of ports and their positioning. Thus the porting could be as shown in the aforementioned Smith patent rather than as specifically described above.

Numerous other modifications will suggest themselves to those skilled in the art. It is thus intended that the scope of the invention be limited only by the claims which follow.

I claim:

1. An inflatable packer comprising:

a tubular member, first and second annular heads surrounding said tubular member and longitudinally spaced therealong, said first head being longitudinally slidable on said tubular member, said second head including an attachment portion, a relief being formed between said attachment portion and said tubular member, securing means disposed in said relief for securing said attachment portion to said tubular member and preventing substantial longitudinal movement between said attachment portion and said tubular member, centering means disposed between said second head and said tubular member for maintaining said second head and said tubular member in substantially coaxial relation independently of said securing means, and an expandable, tubular element secured to said first and second heads and extending therebetween.

2. The packer of claim 1 including means for inflating said expandable element by fluid pressure.

3. The packer of claim 1 wherein said relief comprises an annularly extending space between said attachment portion and said tubular member.

4. The packer of claim 1 wherein said securing means comprises an adhesive composition.

5. The packer of claim 4 wherein said adhesive composition comprises an epoxy resin.

6. The packer of claim 4 wherein at least a part of the surface of said attachment portion contiguous said relief contains irregularities.

7. The packer of claim 3 wherein said annularly extending space is formed by an internal, enlarged diameter portion of said second head.

8. The packer of claim 1 wherein said centering means comprises an annular rib formed by a radially inwardly extending portion of said second head.

9. The packer of claim 1 wherein said securing means includes means for grippingly engaging said tubular member.

10. The packer of claim 9 wherein said securing means includes a plurality of gripping elements having gripping teeth thereon for engaging said tubular member.

11. The packer of claim 9 wherein said relief comprises an annularly extending space between said attachment portion and said tubular member.

12. The packer of claim 11 wherein said securing means comprises a collet member, said collet member having a plurality of collet fingers disposed in said annularly extending space, said collet fingers having gripping teeth for engaging said tubular member.

13. The packer of claim 12 wherein said second head has an inwardly tapered threaded section on its inner periphery and said collet fingers having an inwardly tapered threaded section on their outer periphery, said collet fingers being threadedly received in said threaded section of said second head whereby said gripping teeth are urged into engagement with said tubular member.

14. The packer of claim 7 wherein said securing means comprises an adhesive composition.

15. The packer of claim 14 wherein said adhesive composition comprises an epoxy resin.

16. The packer of claim 1 wherein said tubular member comprises a section of well casing.

17. An inflatable packer comprising:

a tubular member, first and second annular heads surrounding said tubular member and longitudinally spaced therealong, said first head being longitudinally slidable on said tubular member, said second head including an attachment portion, a relief being formed between said attachment portion and said tubular member, an adhesive composition disposed in said relief for securing said attachment portion to said tubular member, and an expandable, tubular element secured to said first and second heads and extending therebetween.

18. The packer of claim 17 including means for inflating said expandable element by fluid pressure.

19. The packer of claim 17 wherein said relief comprises an annularly extending space between said attachment portion and said tubular member.

20. The packer of claim 17 wherein said adhesive composition comprises an epoxy resin.

21. The packer of claim 17 wherein at least a part of the surface of said attachment portion contiguous said relief contains irregularities.

22. The packer of claim 17 wherein said tubular member comprises a section of well casing.

23. The packer of claim 20 wherein said annularly extending space is formed by an internal, enlarged diameter portion of said second head.

24. An inflatable packer comprising:

a tubular member, first and second annular heads surrounding said tubular member and longitudinally spaced therealong, said first head being longitudinally slidable on said tubular member, said second head including an attachment portion, a relief being formed between said attachment portion and said tubular member, securing means disposed in said relief for fixedly securing said attachment portion to said tubular body, said securing means grippingly engaging said tubular member, an expandable, tubular element secured to said first and second heads and extending therebetween.

25. The packer of claim 24 including means for inflating said expandable element by fluid pressure.

26. The packer of claim 24 wherein said relief comprises an annularly extending space between said attachment portion and said tubular member.

27. The packer of claim 24 wherein said securing means includes a plurality of gripping elements having gripping teeth thereon for engaging said tubular member.

28. The packer of claim 26 wherein said securing means comprises a collet member, said collet member having a plurality of collet fingers disposed in said annularly extending space, said collet fingers having gripping teeth for engaging said tubular member.

29. The packer of claim 28 wherein said second head has an inwardly tapered threaded section on its inner periphery and said collet fingers have an inwardly tapered threaded section on their outer periphery, said collet fingers being threadedly received in said threaded section of said second head whereby said gripping teeth are urged into engagement with said tubular member.

* * * * *